US007911361B2

(12) United States Patent
Kumabe

(10) Patent No.: US 7,911,361 B2
(45) Date of Patent: Mar. 22, 2011

(54) VEHICLE RECOMMENDATION SPEED DISPLAY SYSTEM

(75) Inventor: Hajime Kumabe, Kariya (JP)

(73) Assignee: Denso Corporation, Kariya (JP)

( * ) Notice: Subject to any disclaimer, the term of this patent is extended or adjusted under 35 U.S.C. 154(b) by 235 days.

(21) Appl. No.: 11/730,945

(22) Filed: Apr. 5, 2007

(65) Prior Publication Data

US 2007/0262883 A1 Nov. 15, 2007

(30) Foreign Application Priority Data

May 10, 2006 (JP) ..... 2006-131601

(51) Int. Cl.
*G08G 1/01* (2006.01)

(52) U.S. Cl. ..... 340/936; 340/995.17; 340/995.26; 340/995.27; 340/996; 701/41; 701/70; 701/93; 701/46; 701/301

(58) Field of Classification Search ..... 340/936, 340/995.17, 996; 701/41, 70, 93, 96, 301
See application file for complete search history.

(56) References Cited

U.S. PATENT DOCUMENTS

| | | | | |
|---|---|---|---|---|
| 567,531 | A * | 9/1896 | Arnold | 248/274.1 |
| 3,596,242 | A * | 7/1971 | Skweres | 340/936 |
| 3,960,410 | A * | 6/1976 | Leitz et al. | 303/139 |
| 4,101,870 | A * | 7/1978 | Ekman | 340/459 |
| 4,874,242 | A * | 10/1989 | Bezard et al. | 356/341 |
| 4,931,767 | A * | 6/1990 | Albrecht et al. | 340/425.5 |
| 5,815,072 | A * | 9/1998 | Yamanaka et al. | 340/461 |
| 5,942,979 | A * | 8/1999 | Luppino | 340/576 |
| 6,188,312 | B1 * | 2/2001 | Gotauco | 340/326 |
| 6,278,928 | B1 * | 8/2001 | Aruga et al. | 701/65 |
| 6,356,833 | B2 * | 3/2002 | Jeon | 701/93 |
| 6,498,976 | B1 * | 12/2002 | Ehlbeck et al. | 701/70 |
| 6,728,623 | B2 * | 4/2004 | Takenaga et al. | 701/96 |
| 6,731,925 | B2 * | 5/2004 | Naboulsi | 455/345 |
| 6,737,963 | B2 * | 5/2004 | Gutta et al. | 340/435 |
| 6,825,778 | B2 * | 11/2004 | Bergan et al. | 340/936 |
| 6,920,234 | B1 | 7/2005 | Koenig et al. | |
| 6,927,694 | B1 | 8/2005 | Smith et al. | |
| 7,202,792 | B2 * | 4/2007 | Zhang et al. | 340/575 |

(Continued)

FOREIGN PATENT DOCUMENTS

DE 36 19 824 12/1987

(Continued)

OTHER PUBLICATIONS

Office Action dated Feb. 2, 2009 in corresponding German patent application No. 10 2007 016 882.0-31 (and English translation).

(Continued)

*Primary Examiner* — Daniel Wu
*Assistant Examiner* — Son M Tang
(74) *Attorney, Agent, or Firm* — Posz Law Group, PLC

(57) ABSTRACT

A vehicle recommendation speed display system includes a vehicle speed sensor, a recommendation speed processing unit that calculates a recommended speed based on a vehicle speed and a display unit that is usually mounted in a speedometer. The recommendation speed processing unit is configured to send information on the vehicle recommended speed to the display unit to display the recommended speed regardless of whether an actual vehicle speed is higher than the recommended speed or not in order to prevent a driver from being irritated by a difference between the actual vehicle speed and a vehicle speed intended by the driver.

16 Claims, 6 Drawing Sheets

U.S. PATENT DOCUMENTS

| | | | | |
|---|---|---|---|---|
| 7,222,009 | B2 * | 5/2007 | Hijikata et al. | 701/41 |
| 7,327,239 | B2 * | 2/2008 | Gallant et al. | 340/438 |
| 7,333,007 | B2 * | 2/2008 | Lengning et al. | 340/439 |
| 7,519,471 | B2 * | 4/2009 | Shibata et al. | 701/211 |
| 2002/0170762 | A1 * | 11/2002 | Daneshmand | 180/178 |
| 2004/0209594 | A1 * | 10/2004 | Naboulsi | 455/404.1 |
| 2005/0131614 | A1 * | 6/2005 | Isogai et al. | 701/93 |
| 2005/0150701 | A1 * | 7/2005 | Michi et al. | 180/170 |
| 2006/0028330 | A1 * | 2/2006 | Gallant et al. | 340/441 |
| 2006/0095193 | A1 * | 5/2006 | Nishira et al. | 701/96 |
| 2006/0235597 | A1 * | 10/2006 | Hori et al. | 701/96 |
| 2008/0157952 | A1 * | 7/2008 | Gallant et al. | 340/441 |

FOREIGN PATENT DOCUMENTS

| | | | |
|---|---|---|---|
| DE | 43 25 721 | | 2/1995 |
| DE | 196 20 467 | | 11/1997 |
| DE | 199 01 808 | | 7/2000 |
| JP | A-9-257507 | | 10/1997 |
| JP | 2002-025000 | | 1/2002 |
| JP | A-2002-163785 | | 6/2002 |
| JP | A-2002-166749 | | 6/2002 |
| JP | A-2002-329300 | | 11/2002 |
| JP | 2004-142686 | | 5/2004 |
| JP | 2004-210053 | | 7/2004 |
| JP | 2004-287856 | | 10/2004 |
| JP | 2004-322962 | | 11/2004 |
| JP | 2005121382 | A * | 5/2005 |
| JP | 2005-140084 | | 6/2005 |
| JP | 2005-227008 | | 8/2005 |
| JP | 2005228137 | * | 8/2005 |
| JP | 2005234758 | A * | 9/2005 |
| JP | A-2005-234775 | | 9/2005 |

OTHER PUBLICATIONS

Office Action dated Oct. 26, 2010 in corresponding Japanese patent application No. 2006-131601 (and English translation).

* cited by examiner

VEHICLE RECOMMENDATION SPEED DISPLAY SYSTEM

CROSS REFERENCE TO RELATED APPLICATION

The present application is based on and claims priority from Japanese Patent Application 2006-131601, filed May 10, 2006, the contents of which are incorporated herein by reference.

BACKGROUND OF THE INVENTION

1. Field of the Invention

The present invention relates to an on-vehicle system that displays a recommendation speed of a vehicle.

2. Description of the Related Art

JP-2004-142686A discloses a vehicle cruise control system that controls the cruising speed of a vehicle. This cruising control system determines a target speed based on the distance of a preceding vehicle from the own vehicle and road information ahead of the own vehicle and reduces the vehicle speed if the vehicle speed is higher than the target speed.

JP-2004-210053A discloses a vehicle cruise control system that controls the cruising speed of a vehicle based on road information about curves of a road and the speed of the vehicle. This cruising control system delays the timing of reducing control of the vehicle speed when there is a preceding vehicle.

However, because the driver is not informed of the target speed by the above cruise control systems, the driver may feel irritated when the driver's intention of the vehicle operation is different from the vehicle speed.

JP-2004-0287856A discloses a display means for displaying a message if the vehicle speed becomes higher than a regulation speed. However, no information is given to the driver when the vehicle speed is controlled based on various other conditions.

SUMMARY OF THE INVENTION

Therefore, an object of the invention is to provide a vehicle recommendation speed displaying system that can prevent the driver from irritating due to a difference between the intention of the driver and the actual vehicle operation that is controlled by a vehicle speed control system.

According to a main feature of the invention, a recommendation speed display system for a vehicle includes a vehicle speed sensor, a recommendation speed processing unit for providing a vehicle recommendation speed based on a vehicle speed and a display unit. The recommendation speed processing unit is configured to send information on the vehicle recommendation speed to the display unit to display the information regardless of whether an actual vehicle speed is higher than the recommendation speed or not.

The recommendation speed display system according to the main feature of the invention may further include one of the following means: means for sensing vehicle conditions so as to provide a vehicle recommendation speed based on one of the vehicle conditions in addition to the vehicle speed; means for monitoring a driver in driving the vehicle; and means for sensing road conditions relating to the vehicle.

In the above cases, the recommendation speed processing unit can provide a vehicle recommendation speed based on a countenance or behavior of the driver in addition to the vehicle speed or information sensed by the means for sensing road conditions in addition to the vehicle speed. In this case, the recommendation speed processing unit may include a neighboring circumstance recognition section, a driver condition recognition section, a vehicle condition recognition section and means for calculating the recommendation speed, and the means for sensing road conditions may include at least one of a laser radar, a road-to-vehicle communication unit and a navigation system.

The recommendation speed display system according to the main feature of the invention may further include a display data formation section for forming a display image based on the recommendation speed.

In the recommendation speed display system according to the main feature of the invention, the recommendation speed processing unit may be configured to provide the recommendation speed that is selected from a plurality of candidates of the recommendation speed that are based on a plurality of kinds of information relating to the vehicle. In this case, the recommendation speed processing unit may be configured to send the information to the display unit to display a basis of providing the recommendation speed in addition to the vehicle recommendation speed.

In the recommendation speed display system according to the main feature of the invention, the display unit may be disposed in the speedometer.

The recommendation speed display system according to the main feature of the invention may further include an operating panel by which a set speed is set by the driver and means for controlling speed of the vehicle within a control speed so that the recommendation speed processing unit can provide the control speed based on the set speed of the operating panel set by the driver.

In this recommendation speed display system: the recommendation speed processing unit may include a control speed calculation section that is configured to send information on the control speed to the display unit to display the control speed; or may provide a subordinate mode in which the vehicle speed is controlled based on a control speed that changes according to the recommendation speed displayed by the display unit. The above control speed calculation section may be configured to further provide a limited period mode in which the vehicle speed is controlled based on a set speed in a limited period until the display recommendation speed of the recommendation speed changes.

In the above recommendation speed display system the display unit may be configured to display the vehicle recommendation speed by a spot light at a portion that corresponds to a speed scale of the speedometer.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

A recommendation speed display system according to a preferred embodiment according to the present invention will be described with reference to the appended drawings.

Figure 1:
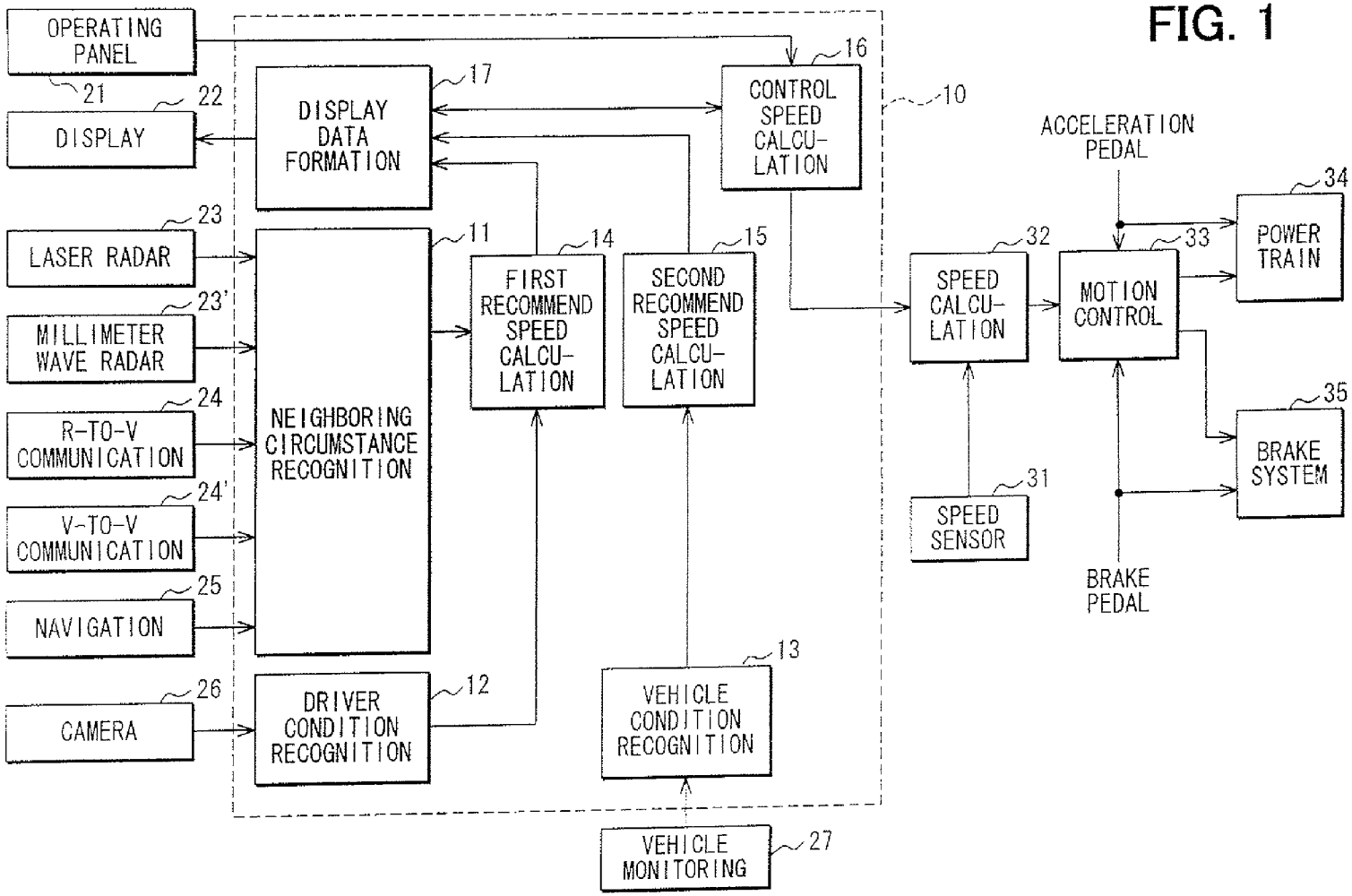
FIG. 1 is a block diagram illustrating a vehicle control system that includes a recommendation speed display system according to a preferred embodiment of the invention.

A vehicle control system that includes the recommendation speed display system will be described with reference to FIG. 1. The vehicle control system is mounted in a vehicle and constructed of a recommendation speed processing unit 10, an operating panel 21, a display unit 22, a laser radar 23, a millimeter wave radar 23', a road-to-vehicle communication unit 24, a vehicle-to-vehicle communication unit 24', a navigation system 25, a camera 26, a vehicle monitoring system 27, a vehicle speed sensor 31, a vehicle speed control value calculation section (hereinafter referred to as speed calculation section) 32, a vehicle motion control section 33, a power train 34, a brake system 35, etc.

The operating panel 21 is provided with plural push buttons for inputting command signals that include the signal of a set speed. Incidentally, the operating panel may be provided with a voice recognition device instead of the push buttons.

The display unit 22 is mounted in a speedometer, as shown in FIGS. 2A-2G The display unit 22 is constructed of a character display section disposed at a central portion of the speedometer and a speed indicating section disposed along the periphery of the speedometer.

Figure 6A:
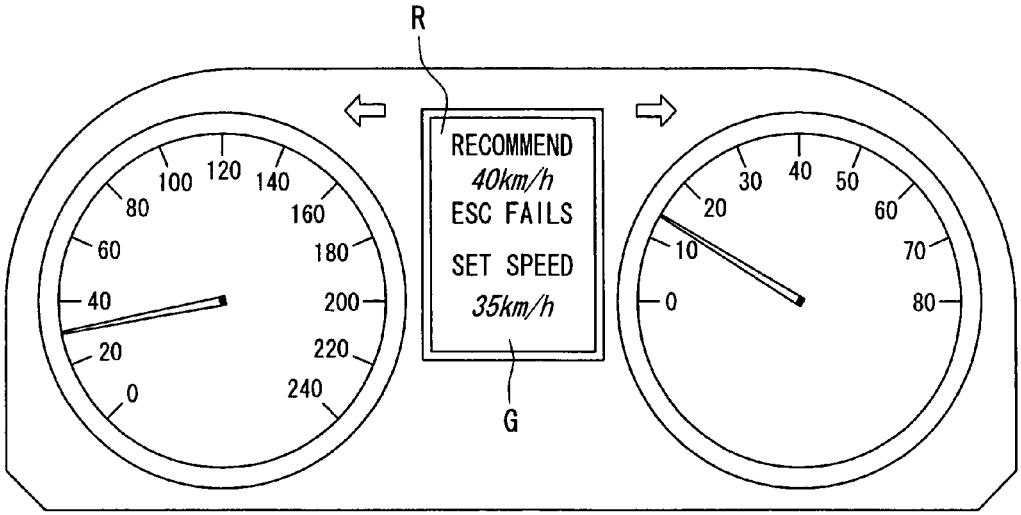
FIGS. 6A and 6B illustrate a meter instrument that includes a liquid crystal display member of the recommendation speed display system.
Figure 6B:
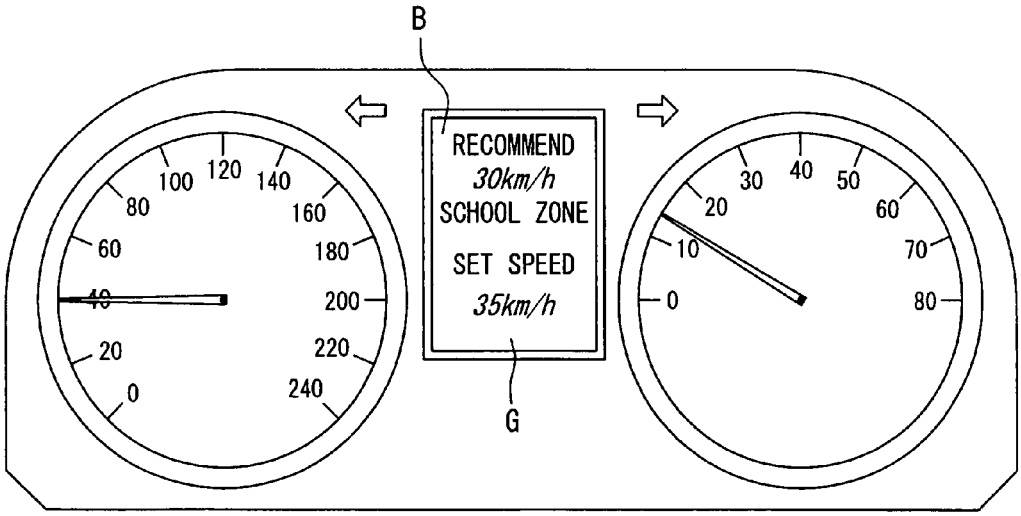
Figure 7:
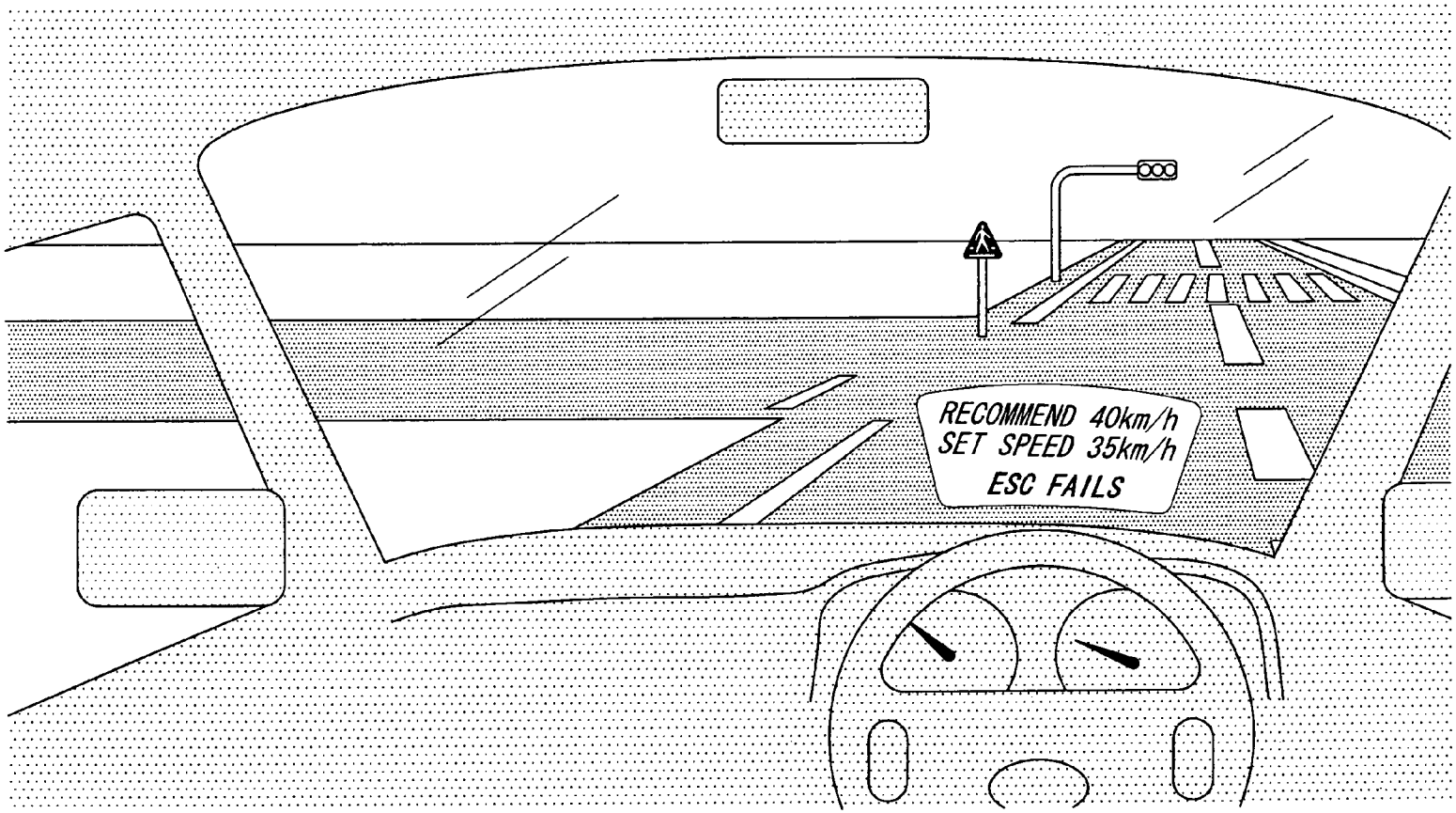
FIG. 7 illustrates a display of the recommendation speed display system projected on a windshield glass.

The character display section is constructed of a liquid crystal display member that displays a message provided by the recommendation speed processing unit 10 by red or blue characters. The speed indicating section is constructed of plural LED's disposed along the periphery of the speedometer so that red (R), blue (B) or green (G) spot light can be turned on at portions that correspond to the scales of the speedometer to indicate a maximum speed, a recommendation speed or a control speed according to a signal provided by the recommendation speed processing unit 10. Incidentally, the display unit 22 may be mounted on a portion of a meter panel, as shown in FIGS. 6A and 6B. The display unit may be mounted in a head up display to display information on a portion of the windshield grass in front of the driver seat, as shown in FIG. 7.

The laser radar 23 is located at the front of the vehicle. The laser radar 23 includes a transmitting section that scans laser light having the directivity right and left and a receiving section that receives reflected light of the laser light. The laser radar 23 detects an object coming up ahead of the vehicle based on the scanned laser light and the reflected laser right, measures the distance between the vehicle and the object and sends its output signal to the recommendation speed processing unit 10.

The radar 23' is also located at the front of the vehicle. The radar 23' includes a transmitting section that emits radio wave and a receiving section that receives reflected wave of the radio wave. The radar 23' detects an object coming up ahead of the vehicle based on the radio wave and the reflected wave of the radio wave, measures the distance and a relative speed between the vehicle and the object, and sends its output signal to the recommendation speed processing unit 10.

The road-to-vehicle communication unit 24 receives various kinds of information, such as information on the highway regulation from an on-road communication facility by means of short-distance wireless communication and sends the data to the recommendation speed processing unit 10.

The vehicle-to-vehicle communication unit 24' receives data on the vehicle speed, vehicle location, vehicle conditions, braking, etc. from an on-vehicle communication device of a neighboring vehicle by means of short-distance wireless communication and sends the data to the recommendation speed processing unit 10.

The navigation system 25 outputs various kinds of information such as the speed limit, traffic jam, blockage of road due to construction or a traffic accident, school zone, residential area, own vehicle location, etc. to the recommendation speed processing unit 10.

The camera 26 periodically monitors the vehicle driver's face or countenance and outputs a monitored image to the recommendation speed processing unit 10.

The monitoring system 27 detects a trouble or an abnormality of the following systems or devices: ESC (electronic stability control) system, ABS (antilock brake control) system, a suspension control system, an electronic four-wheel-driving control system, an electronic differential gear control system, a catalyzer, tire's air pressure, etc. The monitoring system 27 also reports such a trouble or an abnormality to the recommendation speed processing unit 10.

The recommendation speed processing unit 10 provides a control speed based on a signal received from the operating panel 21, sends a control speed signal to the speed calculation section 32 so as to control the vehicle speed within the control speed, as a set speed, and provide a recommendation speed that is optimum under circumstances on the display unit.

The vehicle speed sensor 31 detects the vehicle speed (or running speed of the vehicle). The speed calculation section 32 calculates a control value to control the actual vehicle speed and sends the control value to the vehicle motion control section 33.

The vehicle motion control section 33 controls the power train 34 and the brake 35 based on the control value and the operation of the accelerator pedal and the brake pedal, thereby controlling the vehicle speed within the control speed.

The recommendation speed processing unit 10 is mainly constructed of a microcomputer that includes CPU, ROM, RAM, I/O and bus lines. As shown in FIG. 1, the recommendation speed processing unit 10 includes a neighboring circumstance recognition section 11, a driver condition recognition section 12, a vehicle condition recognition section 13, a first recommendation speed calculation section 14, a second recommendation speed calculation section 15, a control speed calculation section 16 and a display data formation section 17, which may be separated or joined to each other.

The neighboring circumstance recognition section 11 recognizes neighboring circumstances based on the data received from the laser radar 23, the road-to-vehicle communication unit 24 and the navigation system 25 and sends a circumstance recognition signal to the first recommendation speed calculation section 14. The driver condition recognition section 12 recognizes the driver's face or countenance based on the monitored image received from the camera 26 and sends a driver condition recognition signal to the first recommendation speed calculation section 14. The vehicle condition recognition section 13 recognizes a trouble or abnormality of the vehicle based on the data received from the vehicle monitoring system 27 and sends an abnormality recognition signal to the second recommendation speed calculation section 15. The first recommendation speed calculation section 14 calculates plural candidates of recommendation speeds based on the data received from the neighboring circumstance recognition section 11 and driver condition recognition section 12 and outputs the lowest one of the candidates as the recommendation speed to the display data formation section 17. The control speed calculation section 16 calculates a control speed based on the signal received from the operating panel 21 and sends a control speed signal to the display data formation section 17 and the speed calculation section 32. The display data formation section 17 forms a display image based on a first recommendation speed signal received from the first recommendation speed calculation section 14, a second recommendation speed signal received from the second recommendation speed calculation section 15 and a control speed signal received from the control speed calculation section 16 and sends a display image signal to the display unit 22.

Figure 3:
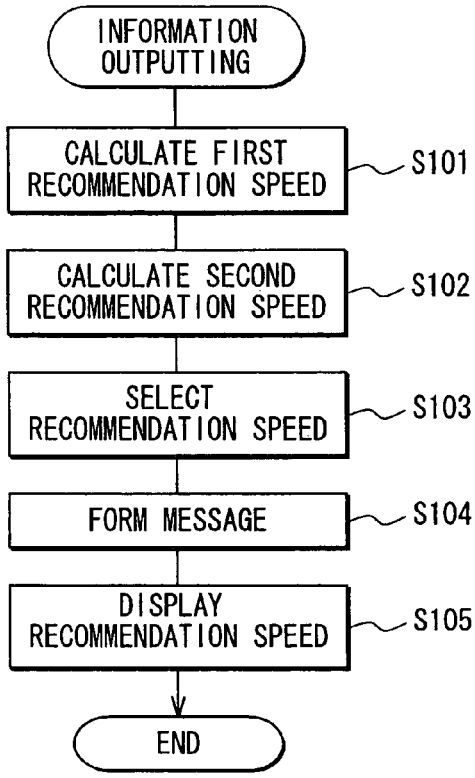
FIG. 3 is a flow diagram of processing data to be displayed.
Figure 4:
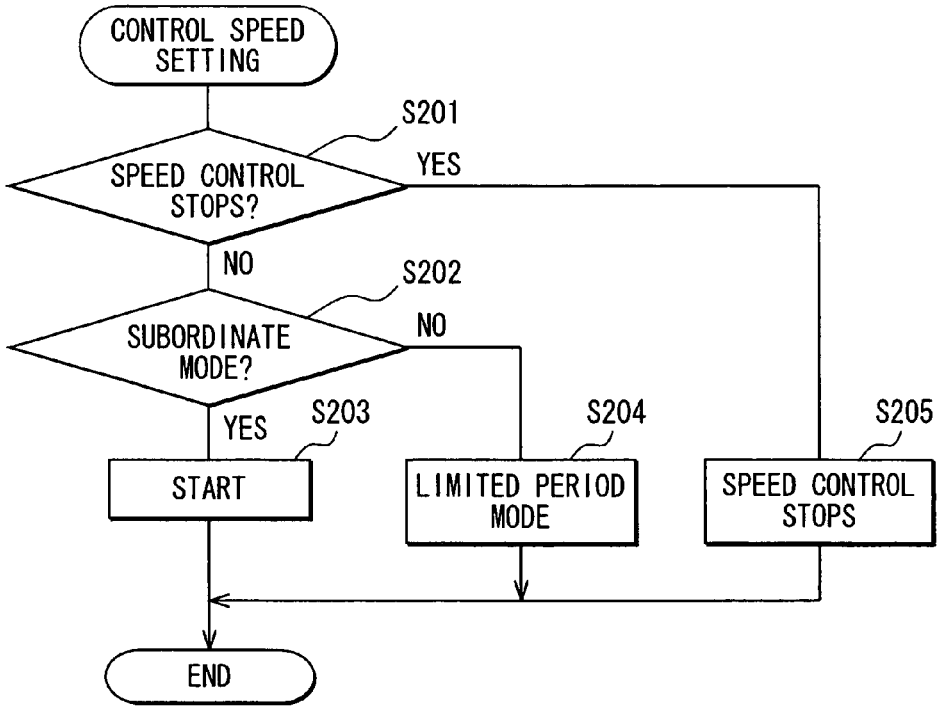
FIG. 4 is a flow diagram of determining a control speed.
Figure 5:
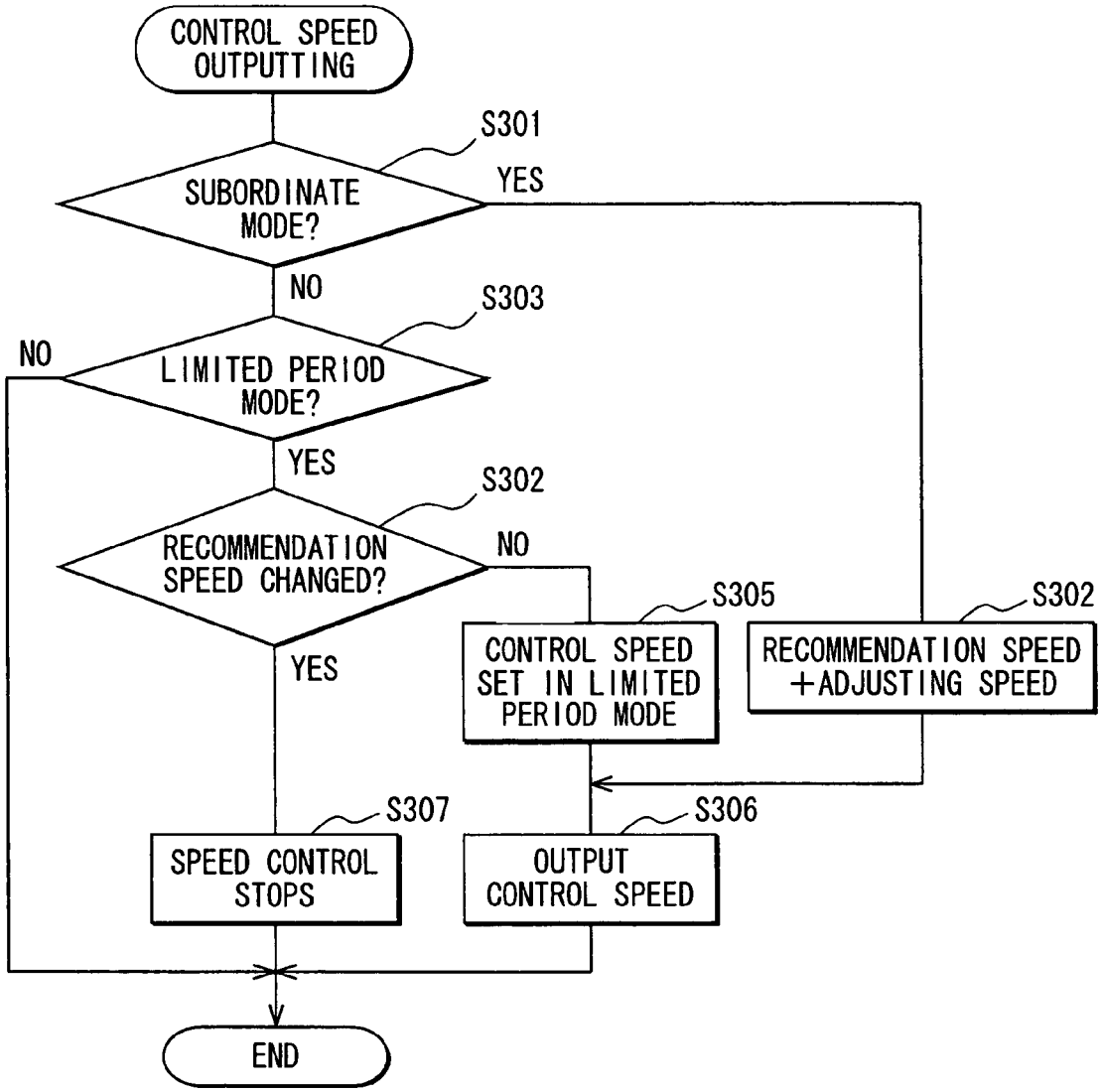
FIG. 5 is a flow diagram of outputting the control speed.

The operation of the recommendation speed processing unit 10 will be described with reference to FIGS. 3-5.

At first, a display information outputting process will be described with reference to FIG. 3. In this process, the first recommendation speed calculation section 14 periodically (e.g. each 100 ms) calculates the first candidates of the recommendation speed based on the data received from the neighboring circumstance recognition section 11 and driver condition recognition section 12, at step S101. In more detail, whether there is any preceding vehicle running ahead of the own vehicle is examined based on the output signal of the laser radar 23, and a candidate of the recommendation speed is set based on a preceding vehicle's speed if there is such a preceding vehicle. Otherwise, the recommendation speed is not set.

Next, if information about a speed limit (caused by side wind, icy road, or fog) is received from the road-to-vehicle communication unit 24, the speed limit is set as a candidate of the recommendation speed. Otherwise, the recommendation speed is not set.

If a speed limit information is detected by the navigation system 25 thereafter, the detected speed limit is set as a candidate of the recommendation speed. Otherwise, the recommendation speed is not set.

If a traffic jam information is detected by the navigation system 25 thereafter, a preset speed for the traffic jam is set as a candidate of the recommendation speed. Otherwise, the recommendation speed is not set.

Then, the sleepiness of the driver is examined based on the data signal received from the camera 26. If it is determined that the driver is sleepy, a preset speed for the sleepy driver is set as a candidate of the recommendation speed. Incidentally, the sleepiness can be judged by the motion of the eyelids. The sleepiness can be also judged by driver's pulsation. In this case, the camera is replaced with a pulse sensor. Instead of sleepiness, driver condition may be examined.

If two or more candidates of the recommendation speed are set, the lowest candidates of the recommendation speed is finally set as the first recommendation speed.

Subsequently, the second recommendation speed is set based on the information about a trouble or an abnormality at S102. In more detail, whether a trouble or an abnormality of the own vehicle takes place or not is examined based on the information received from the vehicle monitoring system 27. If there is a trouble or an abnormality, a preset speed for the trouble or abnormality is set as the second recommendation speed. Otherwise, it is not set.

Subsequently, a display recommendation speed is determined out of the first recommendation speed and the second recommendation speed at S103. If the first and second recommendation speeds are set, the lower one of the recommendation speeds is displayed as the display recommendation speed. If only one of the first and second recommendation is provided, the only one recommendation speed is displayed as the display recommendation speed. If none of the first and second recommendation speed is provided, a preset speed such as the legal speed limit is displayed as the display recommendation speed.

Figure 2A:
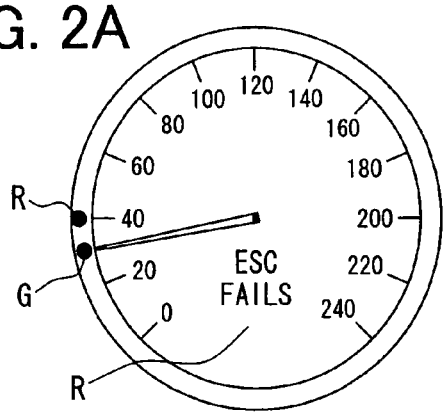
FIGS. 2A-2G illustrate a speedometer in which a display member of the recommendation speed display system is mounted to display various kinds of information.
Figure 2B:
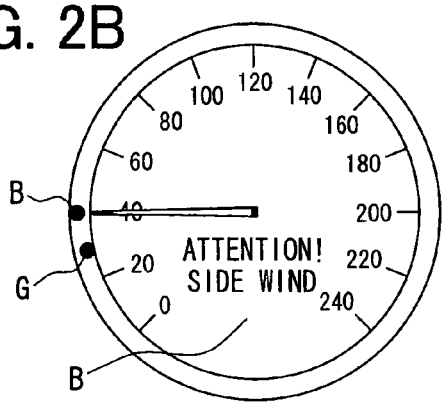
Figure 2C:
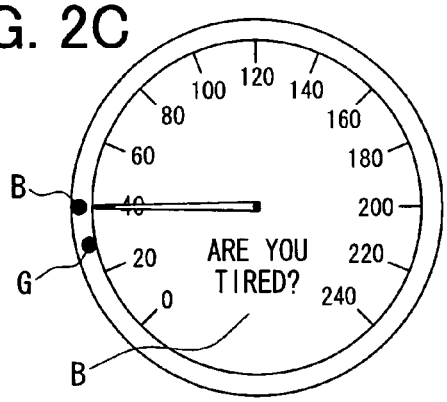
Figure 2D:
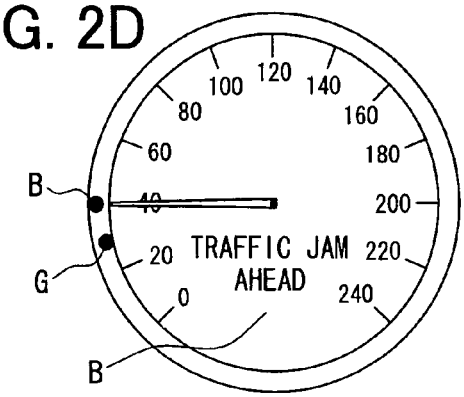
Figure 2E:
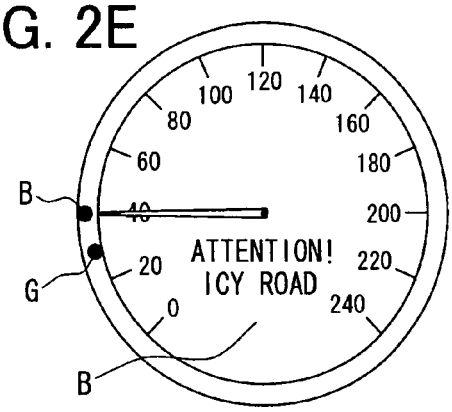
Figure 2F:
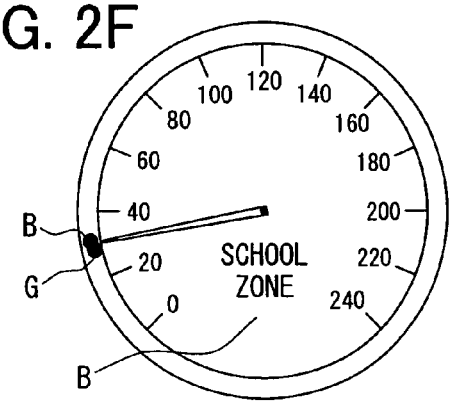
Figure 2G:
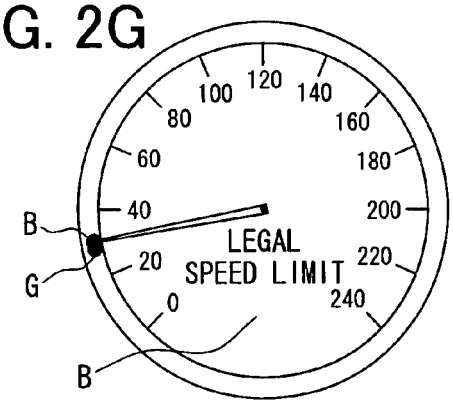

Thereafter, information about reasons of the display recommendation speed is formed at S104 and displayed at S105. If, for example, a display recommendation speed is displayed based on a traffic jam, a blue-colored message "TRAFFIC JAM AHEAD" is formed to be displayed by the display unit 22 with a blue colored display of the display recommendation speed (the first recommendation speed), as shown in FIG. 2D. If the ESC fails, a red-colored message "ESC FAILS" is formed to be displayed with a red-colored display of the display recommendation speed (the second recommendation speed), as shown in FIG. 2A. The red colored message and red colored display recommendation speed represents higher importance than the blue colored message and display recommendation speed.

At S105, the display recommendation speed that is determined at S103, the information about reasons of the display recommendation speed and the control speed that is set at S302 or S305 are outputted to the display unit 22, in which the display recommendation speed is displayed by a red or blue spot light and the control speed is displayed by a blue spot light. Then the display information outputting process is ended.

A control speed setting process for automatically controlling the vehicle speed will be described with reference to FIG. 4.

When the control speed setting process is started by the operating panel 21, whether an operation by the operating panel 21 is to stop speed control or not is examined at S201. If the examination result is NO, whether the operation by the operating panel 21 is to start a subordinate mode or not is examined at S202. The subordinate mode is a mode to control the vehicle speed based on a control speed that changes according to the display recommendation speed displayed by the display unit.

If the result of the examination at the step S202 is YES, the subordinate mode is started at S203, and the control speed setting process is ended thereafter. If the result of the examination at S202 is NO, a limited period mode is started at S204 and, thereafter, the control speed setting process is ended. The limited period mode is a mode to control the vehicle speed based on a set speed in a limited period until the display recommendation speed changes.

When the result of the examination at S 201 is YES, the speed control is stopped at S205, and the control speed setting process is ended.

A control speed outputting process for automatically controlling the vehicle speed will be described with reference to FIG. 5.

When the control speed outputting process is started, whether the mode is the subordinate mode or not is examined at S301. If this examination result is YES, the sum of the display recommendation speed determined at S103 and an adjusting speed (plus or minus value) set when the subordinate mode is started is set as the control speed at S302. Thereafter, the step goes to S306 to output the control speed.

If the result of the examination at S301 is NO, whether the mode is the limited period mode or not is examined at S303. If this examination result is YES, whether the current display recommendation speed has changed from the display recommendation speed when the limited period mode is operated or not is examined at S304. If this examination result is NO, the speed set in the limited period mode is set to the control speed at S305. Thereafter, the control speed set at S302 or S305 is outputted to the speed calculation section 32 at S 306, and the control speed outputting process is ended. On the other hand, if the result of the examination at S303 is NO, the control speed outputting process is immediately ended. If it is judged that the display recommendation speed has changed at S304, the step goes to S307 to end the vehicle speed control operation. Thereafter, the control speed outputting process is ended.

Thus, the recommendation speed display system according to the invention determines a recommendation speed that is optimum for a specific circumstance and displays the display recommendation speed regardless of whether an actual vehicle speed is higher than the display recommendation speed or not. Therefore, a driver can always grasp the display recommendation speed while he is driving the vehicle, so that the driver will not feel irritated by a difference between the intention of the driver and the vehicle operation.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A recommendation speed display system for a vehicle comprising:

a vehicle speed sensor;

sensing means for sensing a plurality of conditions that may affect a vehicle speed;

an operating panel for providing a vehicle control speed setting signal;

a recommendation speed processing unit for providing a display recommendation speed determined based on at least one of the plurality of conditions sensed by the sensing means and a vehicle control speed based on the vehicle control speed setting signal sent from the operating panel, and for sending a plurality of images that include an image of a message on what basis the display recommendation speed is determined, and an image of the display recommendation speed;

a display unit for displaying the plurality of images sent from the recommendation speed processing unit; and speed control means, connected to the recommendation speed processing unit and the vehicle speed sensor, for controlling the vehicle at the vehicle control speed.

2. A recommendation speed display system as in claim 1, wherein the sensing means comprises at least one of a road conditions sensing means, a driver monitoring means for monitoring a driver condition, and a vehicle monitoring means for monitoring a vehicle condition, and wherein the recommendation speed processing unit comprises a neighboring circumstance recognition section connected to the road condition sensing means, a driver condition recognition section connected to the driver monitoring means, a vehicle condition recognition section connected to the vehicle monitoring means calculating means for calculating a plurality of vehicle recommendation speeds and selecting means for selecting the display recommendation speed from the plurality of vehicle recommendation speeds.

3. A recommendation speed display system as in claim 2, characterized in that the vehicle recommendation speed processing unit further comprises a display data formation section, connected to the display unit, for forming a display images to be sent to the display unit.

4. A recommendation speed display system for a vehicle having a speedometer as in claim 1, wherein the display unit is disposed in the speedometer.

5. A recommendation speed display system as in claim 4, wherein the display unit is configured to display a spot light at a portion of a speed scale of the speedometer that corresponds to the display recommendation speed.

6. A recommendation speed display system as in claim 5, wherein the display unit is configured to further display colored message the color of which represents a degree of importance.

7. A recommendation speed display system as in claim 1, wherein the recommendation speed processing unit further comprises a control speed calculation section for providing the vehicle control speed.

8. A recommendation speed display system as in claim 7, wherein the recommendation speed processing unit is configured to send a display image of the vehicle control speed to the display unit in addition to the display recommendation speed and message on what basis the display recommendation speed is determined.

9. A recommendation speed display system as in claim 7, wherein the control speed calculation section is configured to provide a subordinate mode to control the vehicle speed based on a control speed that changes according to the recommendation speed displayed by the display unit.

10. A recommendation speed display system as in claim 9, wherein the control speed calculation section is configured to further provide a limited period mode to control the vehicle speed at the display recommendation speed in a limited period until the display recommendation speed changes.

11. A vehicle recommendation speed display system for a vehicle comprising:

a recommendation speed processing unit, including means for providing a plurality of recommendation speeds on a basis of a neighboring circumstance, a driver condition and a vehicle condition and selecting means for selecting one of the plurality of recommendation speeds; and output means for outputting information sent from the recommendation speed processing unit, wherein the recommendation speed processing unit sends the output means information of selected one of the recommendation speeds and information on what basis the one of the plurality of recommendation speeds is determined wherein the recommendation speed processing unit provides the plurality of recommendation speeds based on a plurality of conditions and selects an optimum recommendation speed from the plurality of recommendation speeds.

12. A recommendation speed display system as in claim 11, wherein the recommendation speed processing unit comprises a neighboring circumstance recognition section connected to the radar, a driver condition recognition section connected to the camera, a vehicle recognition section connected to the vehicle monitoring system.

13. A recommendation speed display system as in claim 11, wherein the recommendation speed processing unit comprises a plurality of recommendation speed calculations sections and a display data information section connected between the recommendation speed calculation sections and the output means.

14. A recommendation speed display system as in claim 11, wherein the plurality of recommendation speeds are provided at the same time by the recommendation speed processing unit.

15. A recommendation speed display system as in claim 11, wherein the recommendation speed processing unit provides the plurality of recommendation speeds based on a plurality of current conditions and selects an optimum recommendation speed from the plurality of recommendation speeds.

16. A recommendation speed display system as in claim 11, wherein the recommendation speed processing unit further comprises:

a first recommendation speed calculation element configured to provide a first recommendation speed based on a first subset of the plurality of current conditions;

a second recommendation speed calculation element configured to provide a second recommendation speed based on a second subset of the plurality of current conditions; and a final recommended speed calculation element configured to select the optimum recommendation speed from the first and second recommendation speeds.

wherein the first subset of the plurality of current conditions and the second subset of the plurality of current conditions are different, and wherein the second recommendation speed calculation element provides the second recommendation speed at the same time as the first recommendation speed calculation element provides the first recommendation speed.

* * * * *